US009276315B2

(12) United States Patent
Noble et al.

(10) Patent No.: US 9,276,315 B2
(45) Date of Patent: Mar. 1, 2016

(54) MEMORY BASED ELECTRONICALLY SCANNED ARRAY ANTENNA CONTROL

(75) Inventors: William B. Noble, Santa Monica, CA (US); Thomas F. Brukiewa, West Hills, CA (US); Larisa Angelique Natalya Stephan, Los Angeles, CA (US)

(73) Assignee: RAYTHEON COMPANY, Waltham, MA (US)

( * ) Notice: Subject to any disclaimer, the term of this patent is extended or adjusted under 35 U.S.C. 154(b) by 691 days.

(21) Appl. No.: 13/350,636

(22) Filed: Jan. 13, 2012

(65) Prior Publication Data

US 2013/0181857 A1 Jul. 18, 2013

(51) Int. Cl.
*H01Q 3/38* (2006.01)
*H01Q 3/26* (2006.01)

(52) U.S. Cl.
CPC ... *H01Q 3/38* (2013.01); *H01Q 3/26* (2013.01)

(58) Field of Classification Search
CPC ..... H01Q 3/38
USPC ..... 342/81
See application file for complete search history.

(56) References Cited

U.S. PATENT DOCUMENTS

| | | | | |
|---|---|---|---|---|
| 4,445,119 | A | 4/1984 | Works | |
| 4,593,286 | A | 6/1986 | Mathews et al. | |
| H126 | H | 9/1986 | Allen et al. | |
| 4,688,045 | A | 8/1987 | Knudsen | |
| 5,008,680 | A | 4/1991 | Willey et al. | |
| 5,027,126 | A * | 6/1991 | Basehgi et al. | 342/372 |
| 5,115,243 | A * | 5/1992 | Perry et al. | 342/158 |
| 6,646,599 | B1 | 11/2003 | Apa et al. | |
| 7,348,932 | B1 * | 3/2008 | Puzella et al. | 343/853 |
| 7,570,640 | B2 * | 8/2009 | LaVigne et al. | 370/389 |
| 2006/0171602 | A1 * | 8/2006 | Ernst et al. | 382/248 |
| 2012/0195426 | A1 * | 8/2012 | White et al. | 380/210 |

FOREIGN PATENT DOCUMENTS

| | | |
|---|---|---|
| EP | 0 361 417 A2 | 4/1990 |
| EP | 0 398 637 A2 | 11/1990 |

OTHER PUBLICATIONS

Stimson, *Introduction to Airborne Radar*, Hughes Aircraft Company, 1983, 577-580, 6 sheets.

(Continued)

*Primary Examiner* — Matthew M Barker
(74) *Attorney, Agent, or Firm* — Lewis Roca Rothgerber Christie LLP

(57) ABSTRACT

A system for controlling an active electronically scanned array (AESA) antenna, which enables the AESA antenna to switch rapidly between different antenna states, includes memories (38) connected to a common address bus (40). Each memory (38) is also connected to a digitally controlled RF signal transmission block (32) within the AESA antenna, and stores digital control words for the digitally controlled RF signal transmission block (32). When a new address is provided on the address bus (40), each memory (38) outputs a new digital control word to its respective digitally controlled RF signal transmission block (32), causing a change in the state of the AESA antenna.

10 Claims, 4 Drawing Sheets

(56) References Cited

OTHER PUBLICATIONS

Written Opinion of the International Searching Authority for International Application No. PCT/US2012/064885, filed Nov. 13, 2012, Written Opinion of the International Searching Authority mailed Feb. 22, 2013 (7 pgs.).

International Search Report for International Application No. PCT/US2012/064885, filed Nov. 13, 2012, International Search Report dated Feb. 15, 2013 and mailed Feb. 22, 2013 (3 pgs.).

International Preliminary Report on Patentability from corresponding international Application No. PCT/US2012/064885, International Preliminary Report on Patentability dated Jul. 15, 2014 and mailed Jul. 24, 2014 (9 pgs.).

Peterson, "Real-Time Digital Image Reconstruction: A Description of Imaging Hardware and an Analysis of Quantization Errors", IEEE Transactions on Sonics and Ultrasonics, vol. SU-31, No. 4 Jul. 1984 (pp. 337-351).

* cited by examiner

MEMORY BASED ELECTRONICALLY SCANNED ARRAY ANTENNA CONTROL

BACKGROUND

1. Field

Embodiments described herein relate to electronically scanned array antennas and in particular to systems for controlling active electronically scanned array antennas.

2. Description of Related Art

An active electronically scanned array (AESA) antenna is an antenna composed of multiple radiating elements, or radiators, the relative amplitude and phase of which can be controlled, making it possible to steer the transmit or receive beams without moving the antenna. Such an antenna includes an array of radiators, or radiating elements. The AESA transmit and receive gain patterns may be uniquely set and may have different polarization states by applying different relative amplitudes and phases in the transmit and receive paths. Each radiator may be connected to a circulator for separating transmitted and received radio frequency (RF) paths having unique transmit/receive electronics. The electronics may include n-way combiner/dividers, for splitting the signal to be transmitted along the path to the radiators, and combining the received signals along the path from the radiators. The electronics may also include digitally controlled elements for adjusting the gain and phase of the signals propagating to or from the radiator, and for switching between the two signal directions, i.e., between the transmitting and receiving modes of the antenna. An electronically controlled attenuator, for example, may be adjusted to control the amplitude of the signal radiated by a radiator, or, if it is followed by a divider, the set of radiators fed directly or indirectly by that divider.

Conceptually, the digitally controlled components used to control amplitude, phase, and signal direction may be grouped into functional blocks referred to herein as digitally controlled RF signal transmission blocks. Supplying a digital control word to such a block through a digital RF block control bus may control the setting of every digitally controlled element in that block. An AESA antenna may contain several varieties of digitally controlled RF signal transmission blocks.

A dominant lobe of an antenna pattern may be referred to as a beam. Such a beam may have several characteristics: the beam direction, which may be characterized by azimuth and elevation angles, the beam width or spoiling, the frequency, and the polarization state. The set of characteristics defining the beam is known as the beam state. If an antenna is designed for both transmitting and receiving operation, then in addition to operating over a range of beam states, the antenna may, at any time, be either transmitting or receiving. The combination of the beam state an antenna is transmitting or receiving, as well as whether it is transmitting or receiving, will be referred to herein as the antenna state. The antenna state may be changed by sending a new digital control word to every digitally controlled RF signal transmission block in the AESA antenna.

The parameters for each digital control word may be recalculated each time the antenna state is to be changed. U.S. Pat. No. 5,008,680, for example, discloses a phase shift control circuit which uses control signals from a beam transform controller, as well as data stored in the phase shift control circuit, to determine the phase shift that the associated phase shifter will impart to the RF signal. In one embodiment, the phase shift control circuit contains multipliers and combiners to form products and sums of combinations of control signals and internally stored data. U.S. Pat. No. 4,445,119 discloses a phased array antenna subsystem in which a distributed beam steering microcomputer is collocated with each of a set of phase shifters. Each microcomputer is used to calculate the phase shift needed from the associated phase shifter to achieve a certain overall beam direction.

In systems requiring that calculations be performed each time the antenna state is to be changed, the rate at which antenna states can be changed may be limited by the time required to perform the calculations. If for example a multiplication is part of the calculation, and if a computer is used which requires some number of clock cycles to perform a multiplication, then the maximum rate at which the antenna state can be changed may be one at which that number of clock cycles elapses before each new antenna state change.

In another prior art embodiment, a small memory, capable of storing a small number of digital control words, e.g., eight digital control words, is associated with each digitally controlled RF signal transmission block. In operation, a central computer calculates all the parameters needed throughout the array for each state when the state is selected. These parameters are loaded into each small memory, during a programming phase, with digital control words corresponding, for example, to eight antenna states. After programming is complete, a beam steering controller may then rapidly switch to any of the eight available antenna states as commanded by the central computer by sending out the corresponding address, which causes the memory contents to be sent to the digitally controlled RF signal transmission block. In this embodiment, antenna state switching may be accomplished rapidly, as long as the switch is to one of the small number of programmed antenna states. A significantly longer delay is incurred when a new beam state must be calculated and then the memories reprogrammed to make one or more new antenna states available. This delay is unacceptable for some AESA applications.

In some modern AESA antenna applications, it is required to be able to switch the antenna state much more quickly to any antenna state supported by the antenna. Thus, there is a need for a system capable of switching among the full range of antenna states, and of doing so without incurring significant delays caused by the calculation time and time to load the required parameters for each antenna state.

SUMMARY

Embodiments of the present invention provide a system for controlling an AESA antenna capable of switching rapidly between antenna states, with switching times that may be much less than 1 microsecond. In an exemplary embodiment, the antenna comprises digitally controlled RF signal transmission blocks, and the system comprises at least one digital memory with address lines for inputting the address of a digital control word (selecting the antenna state) and data lines for outputting the digital control word to a digitally controlled RF signal transmission block (generating the antenna state), and the memory is programmed with one digital control word for every antenna state in a complete set of antenna states. All the digital control words may be precalculated prior to operation of the antenna, eliminating real time calculation of beam parameters and thereby reducing the time required to switch between antenna states. The memory may be non-volatile random access memory (NVRAM) which may be programmed before assembly of the system, or after assembly if the system comprises a data bus suitable for programming. To improve the security of the data stored in the memory, memory words may be stored in encrypted Ruin and decrypted upon retrieval, using a decryption key stored in volatile memory. A packing function may be used in software to map antenna states to memory addresses. Fast volatile memory may be loaded from slower NVRAM to speed switching between antenna states.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of the presently preferred embodiments of a memory based electronically scanned active array antenna control provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features. The term "radio frequency" or "RF" as used herein includes radio frequency signals, microwaves, and millimeter waves, i.e., a frequency range spanning from approximately 1 megahertz (MHz) to 1000 gigahertz (GHz).

Figure 1:
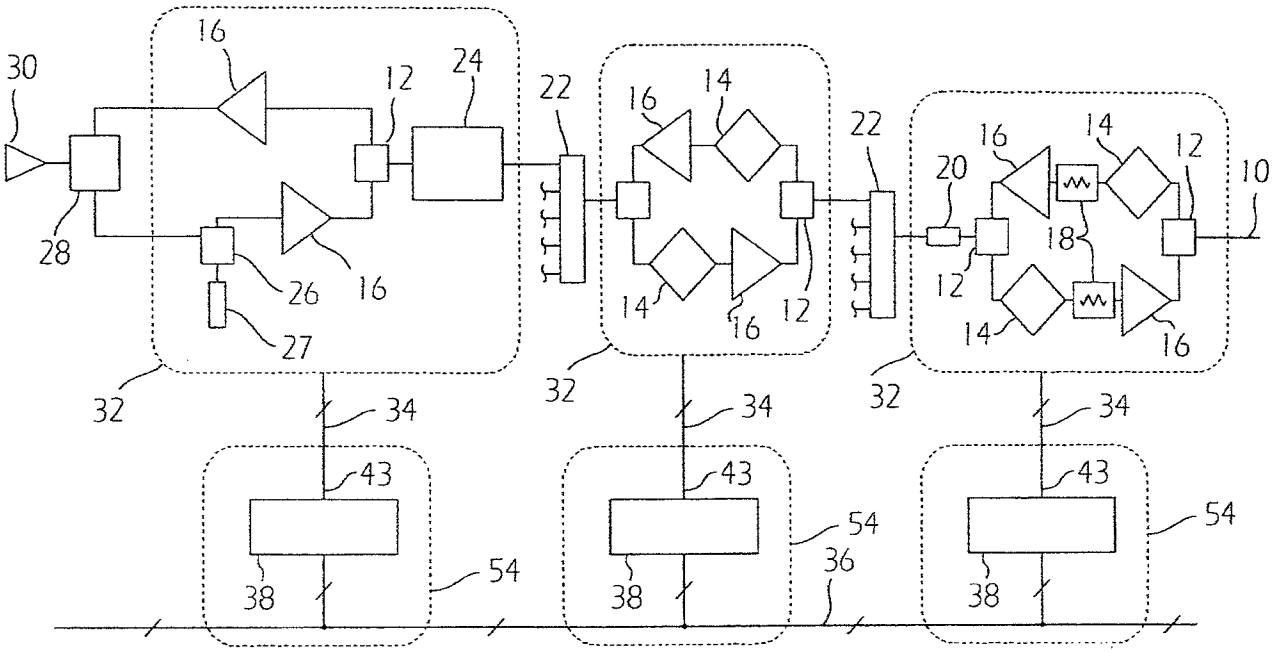
FIG. 1 is a block diagram of digitally controlled RF signal transmission blocks, connected to an AESA radiator, and controlled by digital control blocks according to an embodiment of the present invention.

The present invention relates to systems for controlling AESA antennas. Referring to FIG. 1, in one embodiment the antenna state is controlled by providing digital control words to digitally controlled RF transmission blocks 32 in the antenna. The set of digital control words for controlling a particular digitally controlled RF transmission block 32 is stored in a memory 38. To switch from one antenna state to another, a new address is provided simultaneously to all of the memories 38, each of which then outputs the digital control word stored at that address, causing the settings of the digitally controlled RF transmission blocks 32, and the antenna state, to change. The antenna state is thus determined by the set of digital control words stored at the selected address. The system eliminates the need for real time beam steering calculations, and is capable of switching rapidly between arbitrary antenna states.

Referring to FIG. 1, in one embodiment of the invention, a signal received at a radiator 30 may travel through a circulator 28, and through a series of digitally controlled RF signal transmission blocks 32 and n-way combiner/dividers 22, to reach an RF input/output ("RF I/O") connection 10. A signal to be transmitted may travel in the opposite direction, from the RF I/O 10, through the same digitally controlled RF signal transmission blocks 32, to the radiator 30. The antenna may be designed so that it will not transmit or receive simultaneously; signal direction switches 12 in the digitally controlled RF signal transmission blocks 32 may be used to select which occurs at any time. The switches 12 may be controlled so that when the antenna is transmitting, forward path amplifiers 16 are connected in the signal path, and when the antenna is receiving, return path amplifiers 16 are connected instead. The forward path and return path amplifiers may have different characteristics; the former, for example, may be designed for higher power and the latter for lower noise.

The digitally controlled RF signal transmission blocks 32 may also contain components such as time delay units 14 for shifting the receive or transmit signals in time, gain control blocks 20 consisting of either gain controlled amplifiers or amplifiers with attenuators in series to control the signal gain and attenuators 18 for controlling signal amplitude, and gain and phase control blocks 24 for controlling signal amplitude and producing phase changes. All of these components are digitally controlled, with the number of control bits depending on the number of settings available for that component. An attenuator 18 with 32 available levels of attenuation may for example be controlled by a digital control word of 5 bits. The digitally controlled RF signal transmission block 32 nearest the radiator 30 may also contain a load switch 26 for terminating the receive port of the circulator 28 to a load to ground via load resistor 27 during transmission, to prevent reflections from returning through the circulator 28 and destroying the low noise amplifier. The switches 12 may be controlled by one bit each.

A finite number of antenna states may suffice to exercise all desired operating conditions of the AESA antenna. For example, if it is desired that the AESA antenna be capable of both transmitting and receiving, over a 60×60 degree field of view, with a beam spacing of 2 degrees, then the AESA antenna must be capable of operating in 2×(60/2)×(60/2), i.e., 1800, antenna states (ignoring polarization, frequency and spoiling). In another example, if the set of antenna states is to include transmit and receive beams for each of the same 900 directions, and 4 polarization states, 4 beam widths, and 4 frequencies, then the total number of antenna states required is 2×900×4×4×4, i.e., 115,200. A set of antenna states sufficient to exercise the full capabilities of the AESA antenna is referred to herein as a "complete" set of antenna states. What constitutes a complete set of antenna states will in general depend on the construction of the AESA antenna. It will also in general depend on the beam positioning resolution required by the application. For example, it is typical to position a transmitting beam in steps of a half-power beam width. Positioning to finer granularity than the half power beam width is often of little value, hence it is practical based on current memory technology to quantize all available beam states a-priori and store them in memory for access rather than calculating them as needed as has been done in the prior art. Moreover, an antenna used to transmit and receive will require a larger number of antenna states to form a complete set than a similar antenna used to either transmit only or receive only; similarly changes in the field of view required, frequency range, and so on will increase or decrease the number of antenna states required.

Control signals may be provided to each digitally controlled RF signal transmission block 32 on an RF block control bus 34, consisting of a number of digital lines, each providing a digital "high" (binary 1) or "low" (binary 0) value. The lines in the RF block control bus 34 may be distributed to the components in the digitally controlled RF signal transmission block 32 in accordance with the number of digital control inputs each component has. For example, if a digitally controlled RF signal transmission block 32 contains two digitally controlled switches 12, a 5-bit time delay unit 14, a 5-bit attenuator 18, and a 5-bit gain control block 20, the RF control bus may include a total of 17 bits, which may be used to control all of these components. In the figures, a short diagonal line drawn across a signal path indicates that the path transmits multiple bits in parallel.

In one embodiment, each RF block control bus 34 may be driven directly by a memory data bus 43 comprising one or more data lines. The corresponding memory 38 may be preprogrammed with digital control words, and its address lines may be connected to an address bus 36, so that when a beam-steering controller (not shown) places a new address on the address bus 36, the memory 38 outputs the digital control word stored at the addressed memory location, causing the digitally controlled RF signal transmission block 32 to transmit a signal in the desired direction (i.e., transmitting or receiving), while imparting the necessary amplitude and phase changes to the signal. Note that to form a beam in a particular direction and polarization state, at a particular frequency, the digitally controlled RF signal transmission blocks 32 will be loaded with different sets of parameters; this complete set of parameters across all digitally controlled RF signal transmission blocks 32 is required to form an individual beam state. Thus in the embodiment of FIG. 1, the memories 38 may be identical parts programmed with different data. The address on the address bus 36 may correspond to a particular desired antenna state, and the contents of the memories 38 in the digital control blocks 54 may be the control words needed, at the corresponding digitally controlled RF signal transmission blocks 32, to achieve that antenna state. The memories 38 may have latching outputs, causing the digital control word to persist on the RF block control bus 34 until a new digital control word is selected. Thus in this embodiment all that is required to effect an antenna state change is the placing of a new address on the address bus 36. The corresponding digital control words having been pre-calculated prior to operation, the delays associated with performing such calculations in real time are avoided, and significantly more rapid switching between antenna states is possible.

In an airborne application the beam steering controller, or a computer connected to it, may select the desired beam direction by projecting a grid representing all available beam directions onto the ground and selecting from this set of directions grid cells the one which best corresponds to the desired point on the ground. This may be more efficient than re-calculating the desired beam direction as the aircraft moves or when it is desired to illuminate a different location on the ground. For non-airborne applications analogous projections may be used, as appropriate for the domain. Once the cell representing the direction has been determined, additional dimensions such as polarization, spoiling, and frequency are used to look up the associated beam state number that is used to address the memory in the antenna. The arrangement of this lookup table should be such that software operations on the table in computer memory are efficient. The output from the software is the number of each desired beam state that the antenna is to produce. This list of beam states is supplied to the antenna, which, as described in paragraphs above, then retrieves the beam state parameters from its memories 38 and produces the requested beam.

In operation, some antenna states may not be useful. For example, in a particular installation an obstruction may block the antenna's field of view in some direction, preventing the antenna from transmitting in, or receiving from, that direction. Addresses in the memories 38 that, in an unobstructed installation, would be used to store digital control words for this beam direction, may then instead be used to store digital control words for another beam direction. As a result, the arrangement of digital control words in the memories 38 may be irregular or fragmented. To accommodate the placement of digital control words at arbitrary locations in the memories 38, a packing function may be used in software to map any desired antenna state into a corresponding address in the memories 38. Such a packing function may be implemented, for example, as a lookup table, or as a suitably constructed hash function.

Each memory 38 is programmed with a set of control words prior to operation. This may be accomplished as follows. First, a complete set of antenna states is identified, and each state is numbered. Next, for each of the antenna states, the amplitude and phase required at each digitally controlled RF signal transmission block 32, which defines all the parameters between each radiator 30 and the I/O 10, and the corresponding digital control word, are determined. Approximate values for the digital control words may first be obtained numerically from a model of the antenna, and then refined in an empirical calibration step, in which adjustments to the control words are made, while measuring the beam characteristics, until the desired characteristics are achieved. Calibration may be needed in part because of fabrication imperfections in the antenna components, or because of changes with time in their characteristics, or because of the effects of external components such as a radome or a nearby conductive element. By including post calibration values in the lookup table, the need for a separate calibration lookup table is eliminated.

This embodiment makes it possible to switch between arbitrary antenna states at speeds limited only by the speed at which the address can be updated on the address bus 36, the response times of the memories 38, and the speed at which the digitally controlled RF signal transmission blocks 32 can adjust to new digital control words. The embodiment also makes it possible to operate with fewer wires, or printed wiring board traces, by locating the memory associated with each radiator element close to the components driving that radiating element. In an AESA antenna with 1000 digitally controlled RF signal transmission blocks 32, for example, if each digitally controlled RF signal transmission block 32 requires a 17 bit digital control word, 17,000 printed wiring board traces might be required if a central control unit were to control all through a wide parallel control bus. Twice this many traces, or 34,000 traces, might be required if differential signaling is used. In the present embodiment, the width of the address bus 36, which is used to select an antenna state, is determined instead by the number of antenna states needed. For example, if 1800 antenna states are needed then the address bus 36 must be at least 11 bits wide; if 115,200 antenna states are needed then a 17 bit wide address bus 36 is needed.

The memories 38 in the embodiment of FIG. 1 may be nonvolatile random access memory (NVRAM) programmed prior to assembly.

Figure 2A:
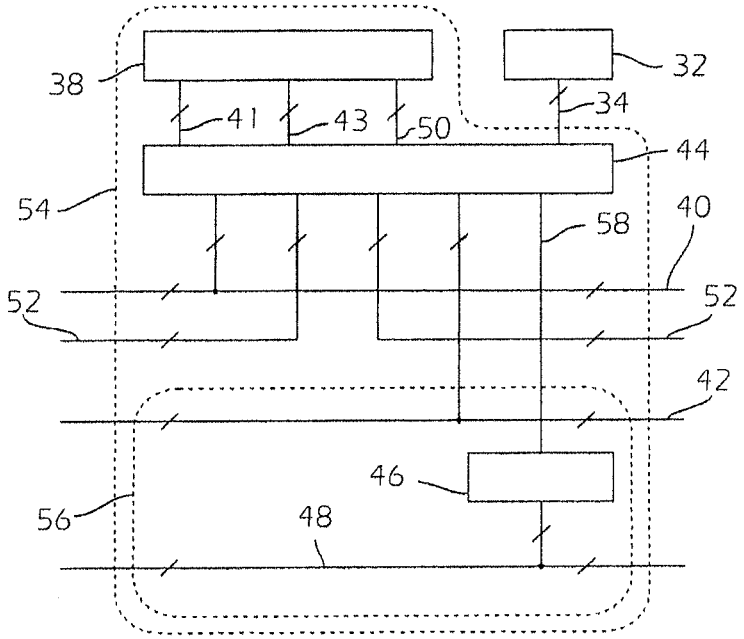
FIG. 2A is a block diagram of a digitally controlled RF signal transmission block controlled by digital control block in a configuration suitable for programming and operation according to an embodiment of the present invention.

Referring to FIG. 2A, in another embodiment, the memories 38 may be programmed after they are installed in the AESA antenna. In this embodiment, means for programming the memories 38 in situ may be a part of the antenna. Control logic 44 forms an interface between the system word address bus 40, the system data bus 42, the memory 38, and the digitally controlled RF signal transmission block 32. One memory 38 may be associated with each digitally controlled RF signal transmission block 32.

The memories 38 may be programmed one at a time. The address on the block address bus 48 identifies the memory 38 to be programmed, and the block address decode logic 46 asserts the write data signal 58 if the memory 38 with which it is associated is to be programmed. When the write data signal 58 is asserted the control logic 44 copies the address and data from the system word address bus 40 and the system data bus 42 onto the memory word address bus 41 and the memory data bus 43, which are connected to the address and data lines respectively of the memory 38, and sets the appropriate bits in the memory control bus 50 to effect a write to the memory 38.

Figure 2B:
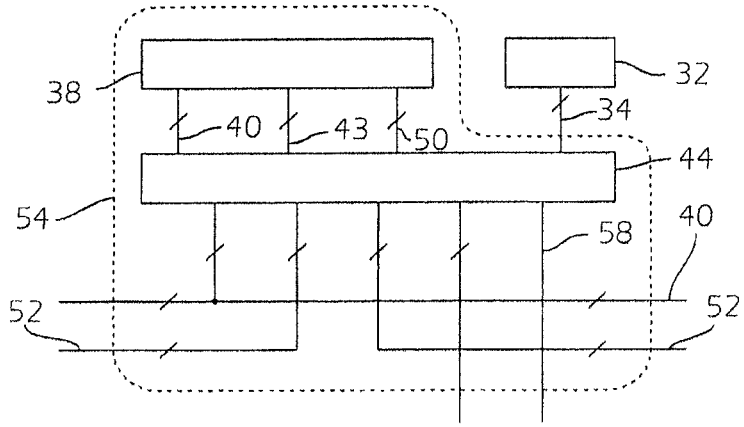
FIG. 2B is a block diagram of a portion of the embodiment of FIG. 2A suitable for operation.

Referring to FIG. 2B, after programming, and during operation, the components forming the programming element 56 are inactive and they may, if desired, be disconnected and removed. To switch to a new antenna state, the beam steering controller places the corresponding address on the system word address bus 40. The control logic 44 copies this address to the memory word address bus 41, and copies the resulting data from the memory data bus 43, which then contains the desired digital control word, to the RF block control bus 34. The copying of addresses and data by the control logic 44 need not add significant delay. The system address bus 36 may for example be connected directly to the memory 38 address bus 36 via wires in the control logic 44. Similarly, the memory data bus 43 may be directly wired to the RF block control bus 34, although some means for disconnecting this bus from the system data bus 42 must be provided by the control logic 44 to prevent the memories 38 from driving this shared bus during programming.

In the embodiment of FIG. 1 it may be necessary, and in the embodiments of FIG. 2A and FIG. 2B, it may be desirable, to use NVRAM for the memories 38. The use of NVRAM, however, carries the potential disadvantage that should the antenna come into the possession of an adversary, the adversary may be able to gain some understanding about the operation of the antenna from the contents of the memories 38. It may be desirable, therefore, to encrypt the contents of the memories 38 and to store the decryption key in volatile memory, so that after an interruption in power the contents of the memories 38 will be essentially worthless to anyone lacking the key.

Referring to FIG. 2B, this may, in one embodiment, be accomplished using exclusive-OR (XOR) encryption. The control logic 44 may store a decryption key segment having the same width in bits as the RF block control bus 34, and during operation control logic 44 may, instead of connecting the memory data bus 43 directly to the RF block control bus 34, XOR the value on the memory data bus 43 with the decryption key segment and place the result on the RF block control bus 34. This decrypting operation may incur an additional delay of as little as one gate propagation delay.

The decryption key, which is a bit string consisting of a concatenation of all of the decryption key segments, may be sent to the control logic 44 at startup, using, for example, an additional bus such as the decryption key load bus 52. This produces an extremely long, hence quite secure, key. If, for example, each decryption key segment is stored in a shift register in the control logic 44 then the decryption key may be shifted into the control logic blocks 44 in series, until every shift register has been loaded with its respective decryption key segment. To improve access speeds, the NVRAM content may be copied, after decryption if applicable, to high speed RAM.

The digital control words may, in one embodiment, be calculated in advance and stored in what is known herein as non-volatile intermediate storage, and then transferred to the memories 38 prior to operation. The non-volatile intermediate storage may be a removable flash memory, for example, which may be connected to the antenna temporarily for the purpose of programming the memories 38. The non-volatile intermediate storage may also be part of the antenna. In this case, transferring the digital control words from the non-volatile intermediate storage to the memories 38 may carry the benefit of faster operation, if the memories 38 have shorter access times than the non-volatile intermediate storage.

Well known compression algorithms may be used to reduce the total memory needed by exploiting patterns. For example, the digital control words corresponding to transmitting a given beam state and receiving the same beam state may differ only in the setting of the bits corresponding to the switches 12, or by a single bit if the switches share one bit. In this case the control logic 44 may supply the bit or bits for controlling the switches 12, and the memory 38 may contain only the remainder of the digital control word. Similarly, if for example, at one frequency three bits of a phase shifter are unused, memories 38 storing fewer bits at the corresponding addresses may be used. In another example, if digital control words for similar antenna states differ little, the memory may store the differences between digital control words, instead of the entire digital control word, for some antenna states, and the difference may be added to the existing beam state upon retrieval. Similarly, an antenna may be dynamically partitioned into two or more sub-arrays the set of which can form multiple independent beams all controlled as described herein.

Figure 4:
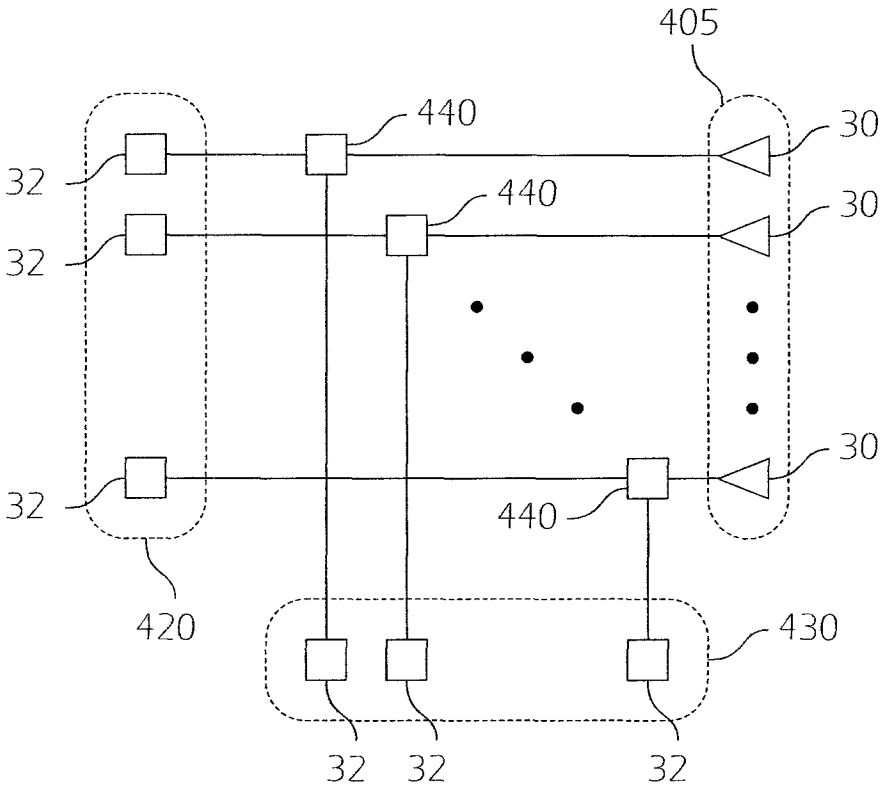
FIG. 4 is a block diagram of two independent sets of transmit/receive electronics connected to a single set of radiators, according to an embodiment of the present invention.

Referring to FIG. 4, two or more independent beams may be transmitted simultaneously by a single set 405 of radiators 30, by connecting two or more independent sets 420, 430 of transmit/receive electronics to the set of radiators 30 using combiners 440. In a similar manner, two or more beams may be received simultaneously. In such an embodiment, each set of transmit/receive electronics may be controlled using the invention disclosed herein.

Figure 3:
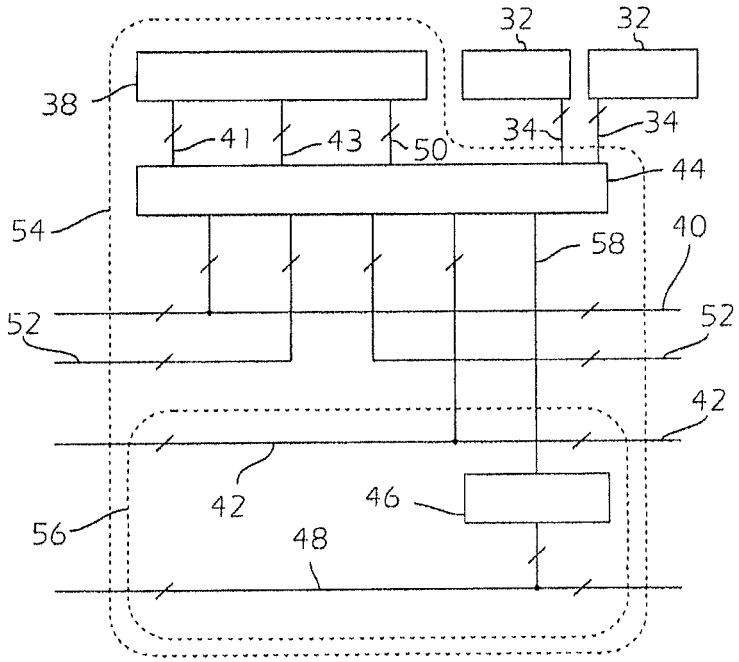
FIG. 3 is a block diagram of two digitally controlled RF signal transmission blocks controlled by a digital control block according to an embodiment of the present invention.

The correspondence between memories 38 and digitally controlled RF signal transmission blocks 32 need not be one to one. Referring to FIG. 3, one digital control block 54 may control multiple digitally controlled RF signal transmission blocks 32. If, for example, the memory 38 is 32 bits wide, and one digitally controlled RF signal transmission block 32 requires 17 control bits and another digitally controlled RF signal transmission block 32 requires 13 control bits, then the control logic 44 may discard 2 bits of every word read from memory 38, send 17 bits of the word to the first digitally controlled RF signal transmission block 32 over a 17 bit wide RF block control bus 34, and send the remaining 11 bits to the other digitally controlled RF signal transmission block 32 over an 11 bit wide RF block control bus 34.

Although limited embodiments of a memory based electronically scanned array antenna control have been specifically described and illustrated herein, many modifications and variations will be apparent to those skilled in the art. For example, instead of addressing memory locations individually during programming, the memories 38 may be daisy chained and configured as a shift register, and the contents shifted from one to the next, until each digital control word is in its proper address. As another example, if the programming element 56 is connected during the process of loading the decryption keys, then instead of shifting these keys in through a daisy chain, one unused memory address in each memory may be mapped, by the control logic, to a volatile memory location in the control logic, and this location may be used to store the key.

Accordingly, it is to be understood that the memory based electronically scanned array antenna control constructed according to principles of this invention may be embodied other than as specifically described herein. The invention is also defined in the following claims.

What is claimed is:

1. A system for controlling an active electronically scanned array (AESA) antenna comprising:

a plurality of radiators;

a first plurality of digitally controlled radio frequency (RF) signal transmission blocks;

a second plurality of digitally controlled RF signal transmission blocks; and a plurality of combiners, each radiator of the plurality of radiators being connected, through a combiner:

to a digitally controlled RF signal transmission block of the first plurality of digitally controlled RF signal transmission blocks, and to a digitally controlled RF signal transmission block of the second plurality of digitally controlled RF signal transmission blocks, the system comprising:

at least one memory with address lines configured to input the address of a digital control word and data lines configured to output the digital control word to a digitally controlled RF signal transmission block of the first plurality of digitally controlled RF signal transmission blocks; and the at least one memory programmed with a set of digital control words comprising at least one digital control word for substantially every antenna state in a complete set of antenna states, each RF transmission block of the first plurality of digitally controlled RF signal transmission blocks, and each RE transmission block of the second plurality of digitally controlled RF signal transmission blocks comprising:

a signal direction switch;

a gain and phase control block; and a load switch.

2. The system of claim 1, wherein the at least one memory is nonvolatile random access memory (NVRAM).

3. The system of claim 2, wherein the value of at least one digital control word of the set of digital control words is calculated and programmed into the memory prior to assembly of the system.

4. The system of claim 2, wherein the set of digital control words comprises at least one encrypted digital control word, the system further comprising control logic connected to the at least one memory and to a digitally controlled RF signal transmission block of the plurality of digitally controlled RF signal transmission blocks, the control logic configured to decrypt the encrypted digital control word and to provide the decrypted digital control word to the digitally controlled RF signal transmission block.

5. The system of claim 4, wherein the control logic is configured to perform an exclusive OR of the at least one encrypted digital control word and a decryption key segment, the decryption key segment being stored in volatile memory.

6. The system of claim 1, further comprising a data bus for programming the at least one memory after assembly.

7. The system of claim 6, wherein the set of digital control words comprises at least one encrypted digital control word, the system further comprising control logic connected to the at least one memory and to a digitally controlled RF signal transmission block of the plurality of digitally controlled RF signal transmission blocks, the control logic configured to decrypt the encrypted digital control word employing a decryption key and to provide the decrypted digital control word to the digitally controlled RF signal transmission block.

8. The system of claim 7, wherein the at least one memory is non-volatile random access memory (NVRAM), and at least one decryption key segment is stored in volatile memory in a memory location mapped to an address not used by the NVRAM.

9. A method of controlling an active electronically scanned array (AESA) antenna, the antenna comprising:

a plurality of radiators;

a first plurality of digitally controlled radio frequency (RF) signal transmission blocks;

a second plurality of digitally controlled RF signal transmission blocks; and a plurality of combiners, each radiator of the plurality of radiators being connected, through a combiner:

to a digitally controlled RF signal transmission block of the first plurality of digitally controlled RF signal transmission blocks, and to a digitally controlled RF signal transmission block of the second plurality of digitally controlled RF signal transmission blocks, each RF transmission block of the first plurality of digitally controlled RF signal transmission blocks, and each RF transmission block of the second plurality of digitally controlled RF signal transmission blocks comprising:

a signal direction switch;

a gain and phase control block; and a load switch, the method comprising:

calculating a set of digital control words corresponding to a set of antenna states, the set of digital control words comprising at least one digital control word for substantially every antenna state in a complete set of antenna states, programming the set of digital control words into a memory, outputting the at least one digital control word from the memory to at least one digitally controlled RF signal transmission block of the first plurality of digitally controlled RF signal transmission blocks, and transmitting or receiving an RF signal with the antenna, using the at least one digitally controlled RF signal transmission block.

10. The method of claim 9, further comprising the step of encrypting at least one of the digital control words prior to programming the memory with it.

* * * * *